US006382810B1

(12) United States Patent
Tseng

(10) Patent No.: US 6,382,810 B1
(45) Date of Patent: May 7, 2002

(54) ORNAMENTAL LAMP

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/677,504

(22) Filed: Oct. 2, 2000

(51) Int. Cl.[7] ..... H01R 33/90

(52) U.S. Cl. ..... 362/226; 362/806; 362/238; 439/619

(58) Field of Search ..... 362/226, 806, 362/238, 249; 220/201 R; 313/318.05, 318.03; 439/356, 619, 611, 699.1, 699.2

(56) References Cited

U.S. PATENT DOCUMENTS 4,999,751 A * 3/1991 Chen ..... 362/226

6,023,127 A * 2/2000 Huang ..... 313/318.01

* cited by examiner

*Primary Examiner*—Sandra O'Shea
*Assistant Examiner*—Hargobind S. Sawhney
(74) *Attorney, Agent, or Firm*—Thorp Reed & Armstrong, LLP

(57) ABSTRACT

An ornamental lamp has a lamp holder, a lamp base and a bulb. The lamp holder defines a conical hollow whose diameter of an upper portion is larger than that of a lower portion. The lamp base has a rippled ring received in the conical hollow of the lamp holder. The rippled ring has an inner periphery formed with a plurality of first arcuate sections protruded inwardly, and an outer periphery formed with a plurality of second arcuate sections protruded outwardly. The bulb is fitted in an internal hollow defined by the first arcuate sections of the rippled ring.

6 Claims, 3 Drawing Sheets

ORNAMENTAL LAMP

BACKGROUND OF THE INVENTION

1. Field of the Invention

The present invention relates to an ornamental lamp and, more particularly, to an ornamental lamp capable of effectively securing its lamp bulb.

2. Description of Related Art

Generally, an ornamental lamp, such as a Christmas lamp, is composed of a bulb, a lamp base for supporting the bulb, and a holder for securing the lamp base and bulb. In order to increase the combination of the lamp stalk and the holder, U.S. Pat. No. 5,785,412 granted to Wu et al. teaches a lamp socket unit whose lamp base has a deformation means for being received in a lamp holder.

Although the above lamp has an enhanced combination strength, the use of such a lamp is still not satisfactory because the securing force is too concentrated on one side or a particular area. Therefore, the combination effect is not enough and the bulb is likely to be detached or twisted, which may result in a short circuit problem. Accordingly, there is a desire to have a novel ornamental lamp to mitigate and/or obviate the aforementioned problems.

SUMMARY OF THE INVENTION

The object of the present invention is to provide an ornamental lamp capable of effectively securing its lamp bulb.

To achieve the object, the lamp in accordance with the present invention comprises a lamp holder, a lamp base and a bulb. The lamp holder defines a conical hollow whose diameter of an upper portion is larger than that of a lower portion. The lamp base has a rippled ring received in the conical hollow of the lamp holder. The rippled ring has an inner periphery formed with a plurality of first arcuate sections protruded inwardly, and an outer periphery formed with a plurality of second arcuate sections protruded outwardly. The bulb is fitted in an internal hollow defined by the first arcuate sections of the rippled ring.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
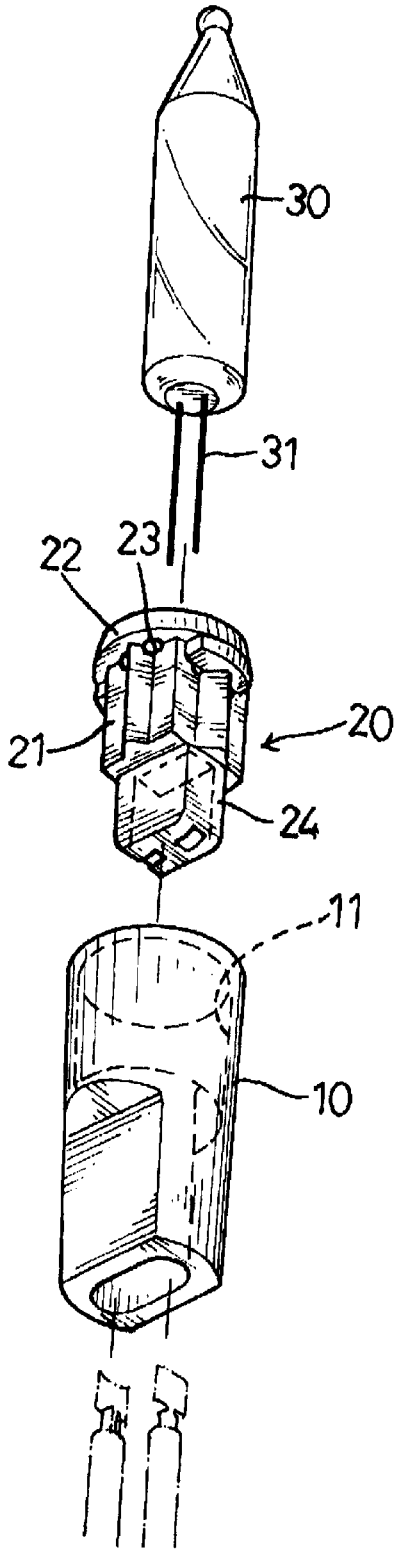
FIG. 1 is an exploded view of an ornamental lamp in accordance with a preferred embodiment of the present invention.
Figure 2:
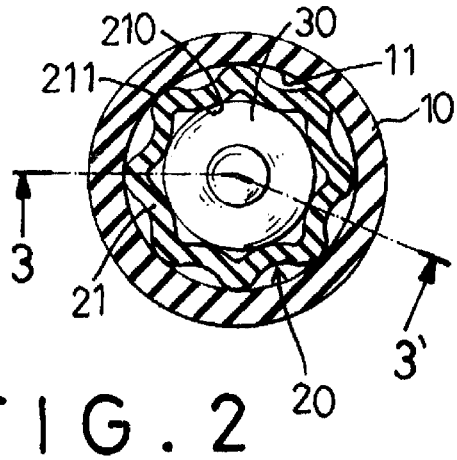
FIG. 2 is a cross sectional view of the lamp in FIG. 1.
Figure 3:
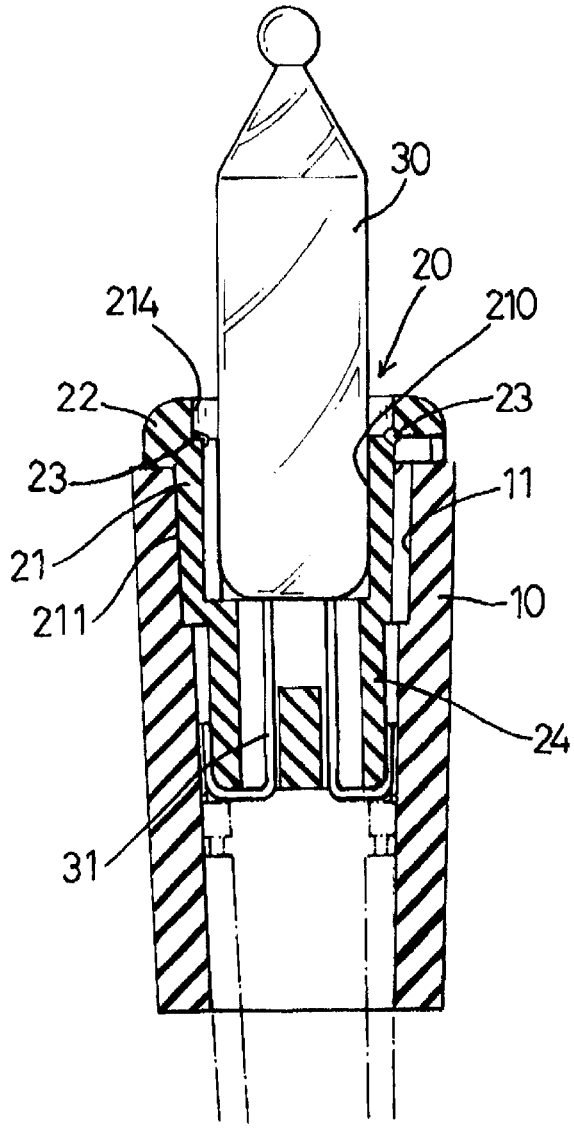
FIG. 3 is a side sectional view taken along section line 3—3 in FIG. 2.

With reference to FIGS. 1, 2 and 3, these drawings show an exploded view and cross sectional views of an ornamental lamp in accordance with a preferred embodiment of the present invention. As shown, the ornamental lamp includes a lamp holder 10, a lamp base 20 and a bulb 30. The lamp holder 10 defines a conical hollow 11 with an upper portion having a larger diameter than that of a lower portion. A bottom part of the lamp holder 10 is for connecting with power leads.

The lamp base 20 has a rippled ring 21 capable of being received in the conical hollow 11 of the lamp holder 10. The rippled ring 21 has a side wall formed continuously with ripples of a consistent shape and size, as shown in FIG. 2. As such, an inner periphery of the rippled ring 21 is formed with a plurality of first arcuate sections 210 protruded inwardly toward the center thereof. Similarly, an outer periphery of the rippled ring 21 is formed with a plurality of second arcuate sections 211 protruded outwardly, and each second arcuate section 211 is integrally formed between two adjacent first arcuate sections 210. Therefore, the external diameter of the rippled ring 21 is defined by the second arcuate sections 211, i.e., the external diameter is substantially equal to the length between two opposite second arcuate sections 211. The external diameter of the rippled ring 21 is slightly larger than the minimum diameter of the conical hollow 11 of the lamp holder 10.

The lamp base 20 further has a rim 22 formed on top of the rippled ring 21. The rim 22 defines an expansion slot 214 having an inner diameter slightly larger than the minimum diameter of an internal hollow defined by the first arcuate sections 210 of the rippled ring 21. An aperture 23 is defined in a position between each first arcuate section 210 and the bottom of the expansion slot 214, so as to enable the first arcuate sections 210 to be elastically stretched. In addition, the lamp base 20 has a wire connection end 24 formed on a bottom face of the rippled ring 21.

The bulb 30 has a predefined external diameter, such that the bulb 30 can be just fitted in the internal hollow defined by the first arcuate sections 210 of the rippled ring 21. The bulb 30 has two leads 31 for extending through the wire connection end 24 of the lamp base 20. Extended ends of the two leads 31 are folded for being positioned, as shown in FIG. 3.

In assembling the ornamental lamp in accordance with the present invention, the bulb 30 and its leads 31 are inserted into the lamp base 20, so that the bulb 30 is held in the internal hollow defined by the first arcuate sections 210 of the rippled ring 21, and each first arcuate section 210 of the rippled ring 21 slightly contacts an outer face of the bulb 30. Then, the lamp base 20 with the inserted bulb 30 is received in the lamp holder 10 by inserting the wire connection end 24 of the lamp base 20 into the lamp holder 10, such that the rippled ring 21 of the lamp base 20 is fitted in the conical hollow 11 of the lamp holder 10. Because the external diameter of the rippled ring 21 is slightly larger than the minimum diameter of the conical hollow 11 of the lamp holder 10, the portion of the conical hollow 11 with a relative small diameter can suppress the second arc sections 211 of the rippled ring 21 of the lamp base 20 inwardly when the rippled ring 21 of the lamp base 20 is inserted into the bottom of the conical hollow 11, such that each second arcuate section 211 is extruded by two adjacent first portions 210 for being deformed inwardly to the bulb 30. As a result, the entire periphery of the bulb 30 can be gripped by the first arcuate sections 210, so as to securely hold the bulb 30.

In view of the foregoing, it is appreciated that the ornamental lamp in accordance with the present invention can utilize the first and second arcuate sections 210 and 211 of the rippled ring 21 to securely hold the bulb 30 thereby preventing the bulb 30 from being detached or rotated.

Figure 4:
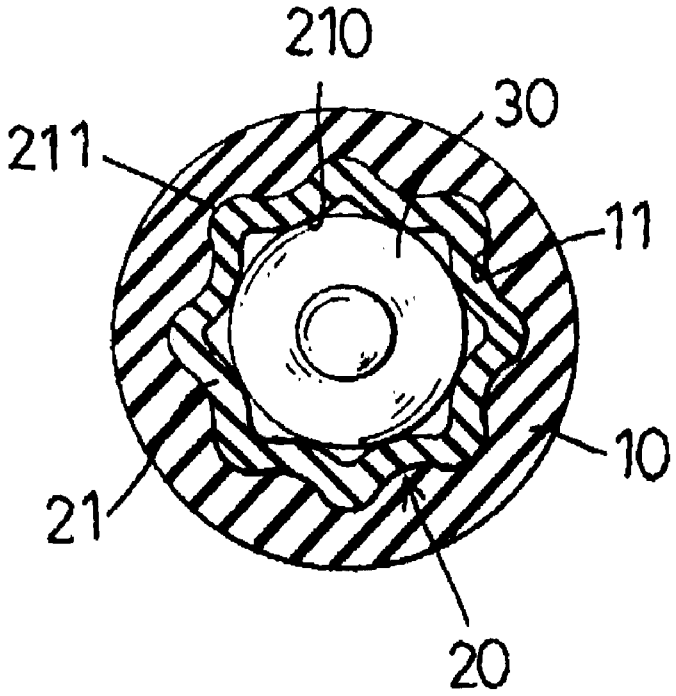
FIG. 4 is a cross sectional view of an ornamental lamp in accordance with another preferred embodiment of the present invention.

FIG. 4 shows another preferred embodiment of the present invention. As shown, the lamp holder 10 has multiple protruded sections formed on an inner periphery defining the conical hollow 11, and each protruded section is received between a respective two of the second arcuate sections 211 of the rippled ring 21 of the lamp base 20. Therefore, the conical hollow 11 is shaped to mate with the rippled ring 21 of the lamp base 20. Accordingly, the rippled ring 21 of the lamp base 20 can be steadily held, so as to further enhance the gripping force to the bulb 30.

Although the present invention has been explained in relation to its preferred embodiment, it is to be understood that many other possible modifications and variations can be made without departing from the spirit and scope of the invention as hereinafter claimed.

What is claimed is:

1. An ornamental lamp, comprising:

a lamp holder defining a conical hollow whose diameter of an upper portion is larger than that of a lower portion;

a lamp base having a rippled ring received in the conical hollow of the lamp holder, the rippled ring having an inner periphery formed with a plurality of first arcuate sections protruded inwardly, and an outer periphery formed with a plurality of second arcuate sections protruded outwardly; and a bulb fitted in an internal hollow defined by the first arcuate sections of the rippled ring.

2. The ornamental lamp as claimed in claim 1, wherein each second arcuate section is integrally formed between a respective two adjacent first arc sections.

3. The ornamental lamp as claimed in claim 2, wherein the rippled ring has an external diameter slightly larger than a minimum diameter of the conical hollow of the lamp holder.

4. The ornamental lamp as claimed in claim 2, wherein the lamp base further has a rim formed on top of the rippled ring, the rim defining an expansion slot having an inner diameter slightly larger than a minimum diameter of the internal hollow defined by the first arcuate sections of the rippled ring.

5. The ornamental lamp as claimed in claim 4, wherein the lamp base further defines a deformable aperture in a position between each first arcuate section and a bottom of the expansion slot, so as to enable the first arcuate sections to be elastically stretched.

6. The ornamental lamp as claimed in claim 1, wherein the lamp holder has multiple protruded sections formed on a periphery defining the conical hollow, each multiple protruded section being received between two second arcuate sections of the rippled ring of the lamp base.

* * * * *